US005538066A

United States Patent [19]

Liu

[11] Patent Number: 5,538,066

[45] Date of Patent: Jul. 23, 1996

[54] GUIDING BRACKET ASSEMBLY FOR A VENETIAN BLIND

[76] Inventor: Tai-Ping Liu, No. 15, Alley 8, Lane 3, Kuochi St., Lungching Hsiang, Taichung Hsien, Taiwan

[21] Appl. No.: 370,315

[22] Filed: Jan. 10, 1995

[51] Int. Cl.[6] ..... E06B 9/30

[52] U.S. Cl. ..... 160/173; 160/178.1

[58] Field of Search ..... 160/177 R, 173 R, 160/178.1 R, 168.1 R, 176.1 R, 178.3 R

[56] References Cited

U.S. PATENT DOCUMENTS

| | | | |
|---|---|---|---|
| 2,721,609 | 10/1955 | Rutledge | 160/177 R |
| 4,333,510 | 6/1982 | Fox | 160/177 R |
| 4,643,238 | 2/1987 | Tachikawa et al. | 160/177 R X |

*Primary Examiner*—Blair Johnson

*Attorney, Agent, or Firm*—Watson Cole Stevens Davis

[57] ABSTRACT

A guiding bracket assembly for a Venetian blind includes a base plate, a pair of parallel side plates each formed on a corresponding one of the distal ends of the base plate and extending upwardly therefrom, a flange portion formed on one distal end of each of the side plates and protruding upwardly therefrom, a pair of extension portions each laterally and horizontally formed on the base plate and each extending outwardly therefrom, a lug portion formed on an underside of each of the extension portions and extending downwardly therefrom, a snapping member laterally formed on one of the lug portions and urging against an underside of a headrail of the Venetian blind, a supporting member formed on the base plate and defining two elongated grooves which are serially arranged and in communication with each other, a pivot axle rotatably mounted in one of the elongated grooves of the supporting member, and a roller fixedly mounted around the pivot axle.

2 Claims, 4 Drawing Sheets

GUIDING BRACKET ASSEMBLY FOR A VENETIAN BLIND

BACKGROUND OF THE INVENTION

1. Field of the Invention

The present invention relates to a guiding bracket assembly, and more particularly to a guiding bracket assembly for a Venetian blind.

2. Related Prior Art

A conventional guiding bracket assembly for a Venetian blind is shown in FIG. 6. However, by such an arrangement, there are still some shortcomings in the conventional guiding bracket assembly.

There will be a more complete and sufficient illustration in the detailed description of the preferred embodiments, concerning the conventional guiding bracket assembly.

The present invention has arisen to mitigate and/or obviate the above-mentioned disadvantages of the conventional guiding bracket assembly.

SUMMARY OF THE INVENTION

The primary objective of the present invention is to provide a guiding bracket assembly which is easily operated.

In accordance with one aspect of the present invention, there is provided a guiding bracket assembly for a Venetian blind which comprises a headrail substantially U-shaped in section, the headrail comprising two side walls each having a hook portion extending inwardly and downwardly therefrom, a pair of first sockets defined in an underside of the headrail each respectively adjacent to a corresponding one of the side walls, a second socket defined in the underside of the headrail between the pair of first sockets, the guiding bracket assembly including a base plate mounted on the underside of the headrail and having two distal ends, an elongated slot vertically defined through a mediate portion of the base plate and communicating with the second socket of the headrail, a pair of parallel side plates each formed on a corresponding one of the distal ends of the base plate and extending upwardly therefrom, a passage horizontally defined through a lower portion of each of the pair of side plates, a flange portion formed on one distal end of each of the side plates and protruding upwardly therefrom to be received in the hook portion of one of the two side walls, a pair of extension portions each laterally and horizontally formed on the base plate and each extending outwardly therefrom, a lug portion formed on an underside of each of the extension portions and extending downwardly therefrom to be received in a corresponding one of the pair of first sockets of the headrail, a channel vertically defined through each of the extension portions and the associated lug portion, a snapping member laterally formed on one of the lug portions and urging against the underside of the headrail, a supporting member formed on the base plate and defining two elongated grooves which are serially arranged and in communication with each other, the elongated slot of the base plate communicating between the two elongated grooves, a pivot axle rotatably mounted in one of the elongated grooves of the supporting member, and a roller fixedly mounted around the pivot axle and partially enclosing the elongated slot of the base plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 6:
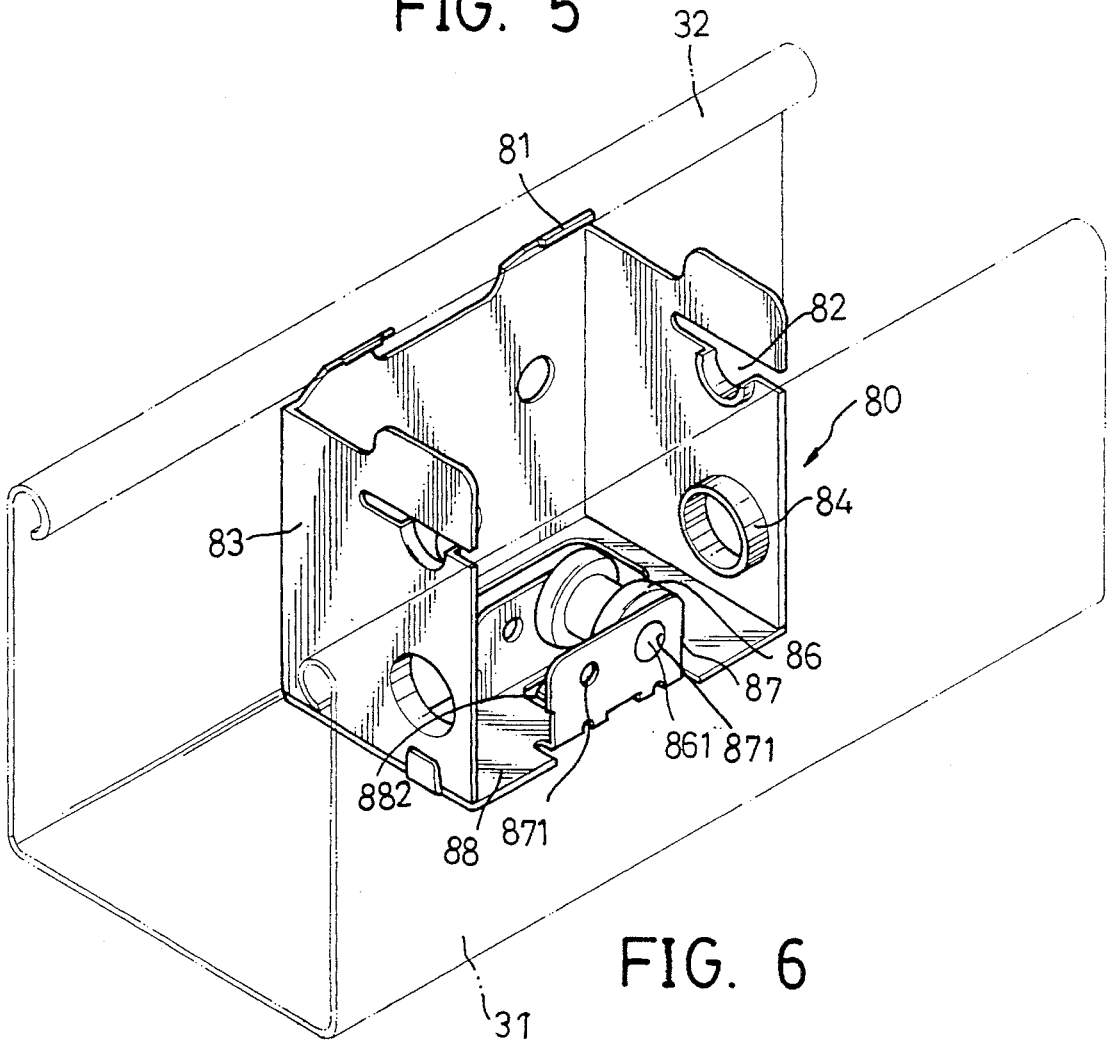
FIG. 6 is a perspective combination view of a conventional guiding bracket assembly engaging in a headrail of a Venetian blind in accordance with the prior art.

Referring to FIG. 6, a conventional guiding bracket assembly 80 in accordance with the prior art-is provided for a Venetian blind (not shown) which comprises a headrail 31 substantially U-shaped in section, the headrail 31 comprising two side walls (not labeled) each having a hook portion 32 extending inwardly and downwardly therefrom. The guiding bracket assembly 80 is integrally formed by pressing/bending processes and comprises two flange portions 81 to be received in one of the hook portions 32 of the headrail 31, a base plate 88 fixedly mounted on an underside of the headrail 31 by rivet means (not shown), two side plates 83 integrally formed on the base plate 88, a supporting member 87 mounted on the base plate 88 and defining two pairs of holes 871, a roller 86 fixedly mounted in the supporting member 87 and engaged between one pair of the holes 871 by a rivet 861, a bore 82 defined in an upper portion of each of the side plates 83, a rotary shaft (not shown) extending through each of the bores 82, a drum (not shown) mounted around the rotary shaft and received between the two side plates 83, an actuating means (not shown) mounted in the Venetian blind for rotating the rotary shaft, a rope (not shown) securely mounted in the drum and having two free ends extending downwardly for controlling the rotational angle of a plurality of slats (not shown), a passage 84 defined in a lower portion of each of the side plates 83, a lift cord (not shown) having one free end passing through the passage 84 and slidably extending across the roller 86 and extending through a hole 882 defined in the base plate 88 to fasten the plurality of slats so as to lift/lower the slats of the Venetian blind. By such an arrangement, the roller 86 is fixedly mounted on the supporting member 87, thereby increasing friction when the lift cord is slidable on the roller 86. In addition, the manufacturer has to produce two types of guiding bracket assemblies 80, one type with the roller 86 thereof mounted on a right end of the supporting member 87 and the other type with the roller 86 thereof mounted on a left end of the supporting member 87, so greatly increasing costs in fabrication.

Figure 2:
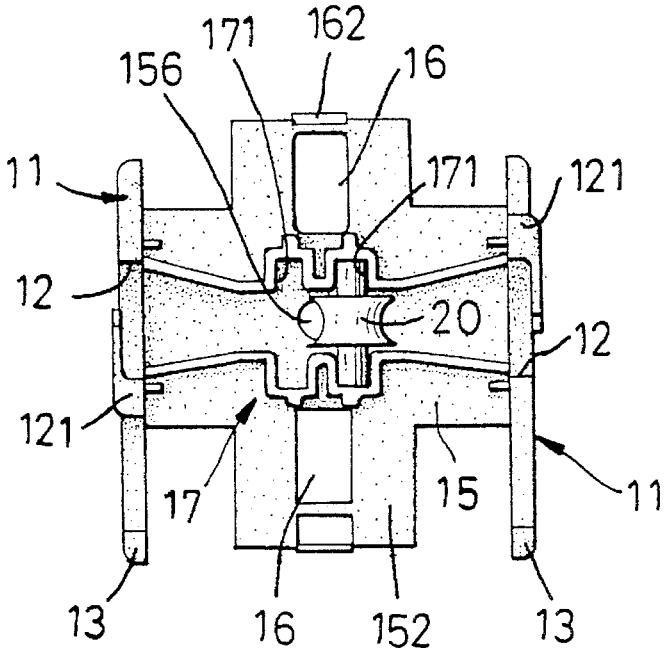
FIG. 2 is a top plan assembly view of the guiding bracket assembly as shown in FIG. 1.
Figure 3:
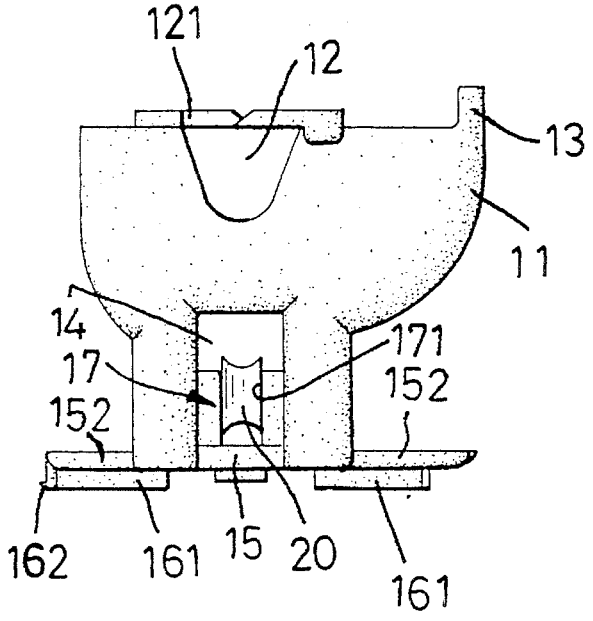
FIG. 3 is a left side assembly view of the guiding bracket assembly as shown in FIG. 1.
Figure 4:
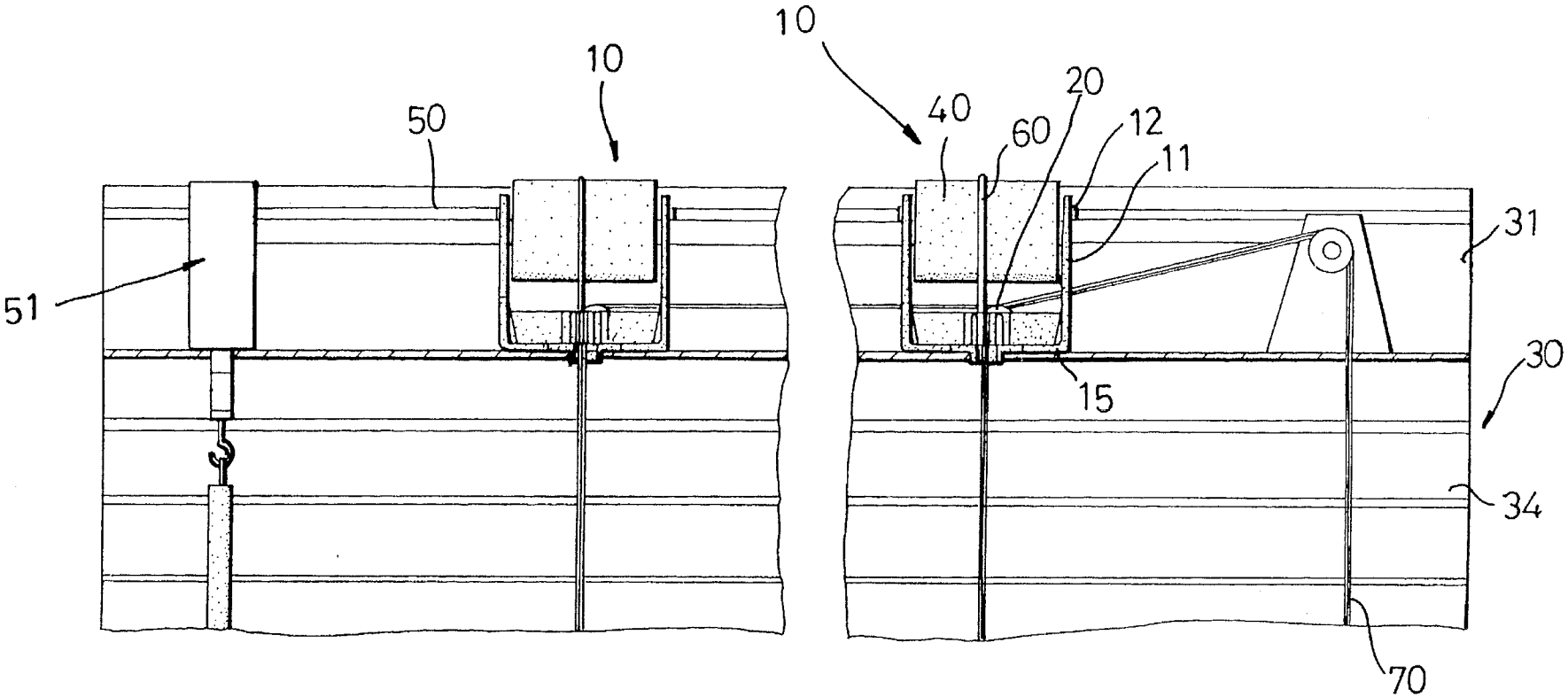
FIG. 4 is front plan partially cross-sectional view of the guiding bracket assembly engaging in a headrail of a Venetian blind.
Figure 5:
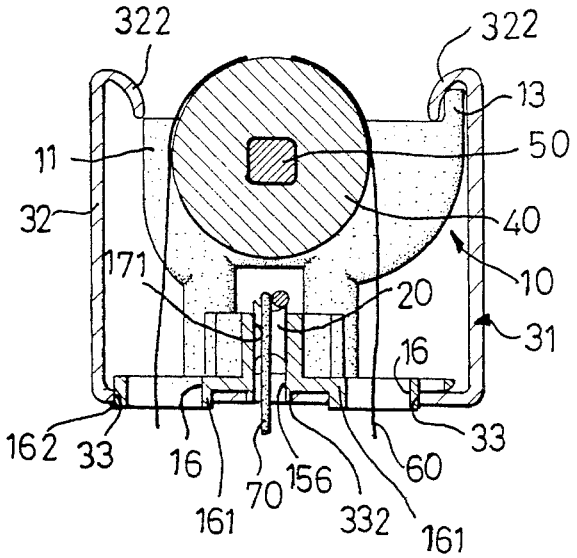
FIG. 5 is a left side cross-sectional view of the combination as shown in FIG. 4.

Referring to FIGS. 1–5 and initially to FIGS. 4 and 5, a guiding bracket assembly 10 in accordance with the present invention is provided for a Venetian blind 30 which comprises a headrail 31 substantially U-shaped in section, the headrail 31 comprising two side walls 32 each having a hook portion 322 extending inwardly and downwardly therefrom, a pair of first sockets 33 defined in an underside of the headrail 31 each respectively adjacent to a corresponding one of the side walls 32, a second socket 332 defined in the underside of the headrail 31 between the pair of first sockets 33.

Figure 1:
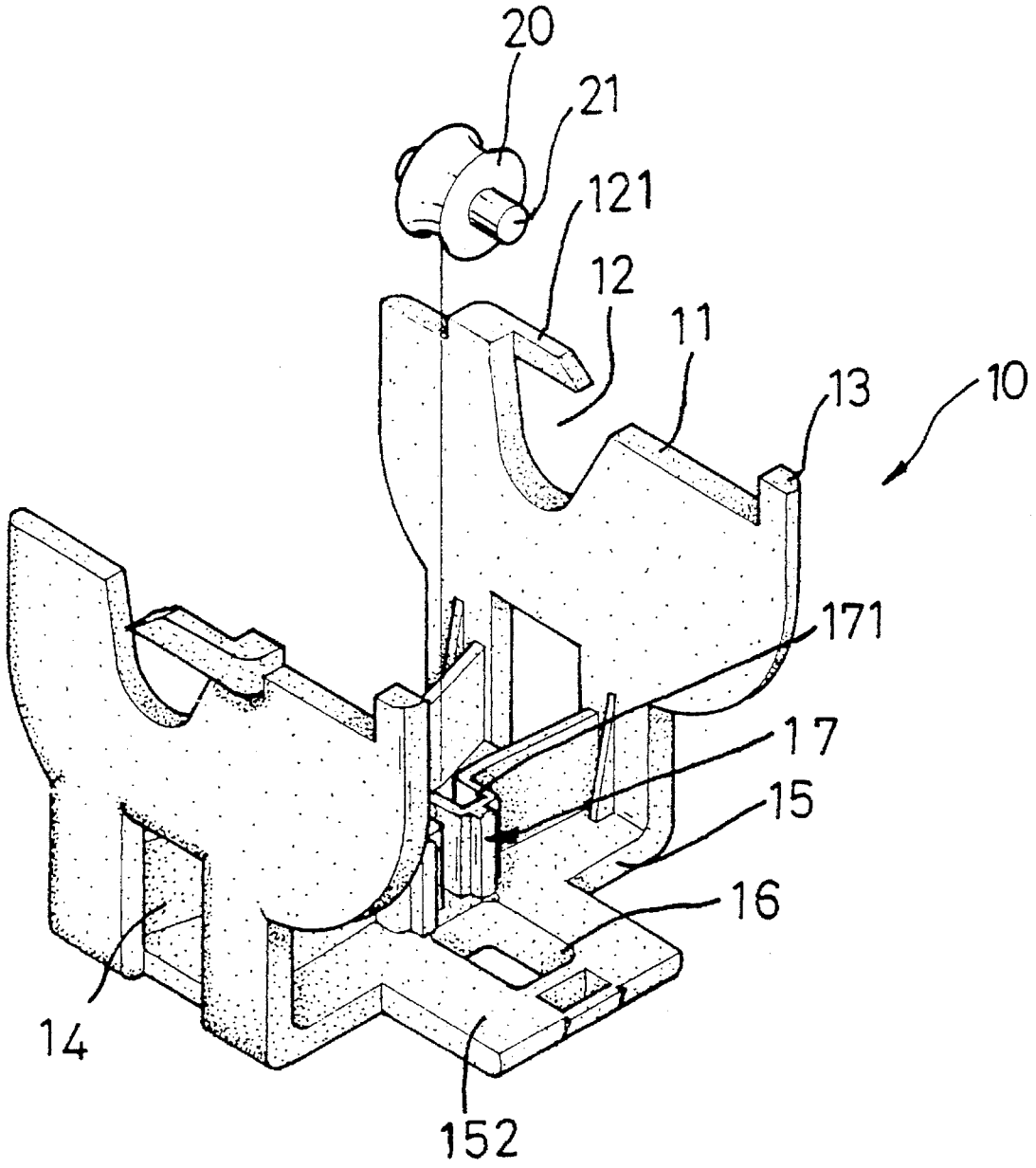
FIG. 1 is a perspective exploded view of a guiding bracket assembly in accordance with the present invention.

Referring to FIGS. 1–3 with reference to FIG. 5, the guiding bracket assembly 10 comprises a base plate 15 mounted on the underside of the headrail 31 and having two distal ends, an elongated slot 156 vertically defined through a mediate portion of the base plate 15 and communicating with the second socket 332 of the headrail 31, a pair of parallel side plates 11 each formed on a corresponding one of the distal ends of the base plate 15 and extending upwardly therefrom, a passage 14 horizontally defined through a lower portion of each of the pair of side plates 11, a flange portion 13 formed on one distal end of each of the side plates 11 and protruding upwardly therefrom to be received in the hook portion 322 of one of the two side walls 32, a pair of extension portions 152 each laterally and horizontally formed on the base plate 15 and each extending outwardly therefrom, a lug portion 161 formed on an underside of each of the extension portions 152 and extending downwardly therefrom to be received in a corresponding one of the pair of first sockets 33 of the headrail 31, a channel 16 vertically defined through each of the extension portions 152 and the associated lug portion 161, a snapping member 162 laterally formed on one of the lug portions 161 and urging against the underside of the headrail 31, a supporting member 17 formed on the base plate 15 and defining two elongated grooves 171 which are serially arranged and in communication with each other, the elongated slot 156 of the base plate 15 communicating between the two elongated grooves 171, a pivot axle 21 rotatably mounted in one of the elongated grooves 171 of the supporting member 17, and a roller 20 fixedly mounted around the pivot axle 21 and partially enclosing the elongated slot 156 of the base plate 15. Preferably, each of the side plates 11 has a recess 12 defined in an upper portion thereof, each of the recesses 12 having a first side and a second side, a pair of stop members 121 each respectively formed on the first side of one of the two recesses 12 and the second side of the other recess 12 and each partially enclosing the associated recess 12.

In operation, referring to FIGS. 4 and 5, two guiding bracket assemblies are respectively and securely mounted in the headrail 31 of the Venetian blind 30, an elongated rotary shaft 50 rotatably mounted in the headrail 31 and extending through the recesses 12 of each of the guiding bracket assemblies 10, an actuating means 51 mounted in the Venetian blind 30 for controlling rotational operation of the rotary shaft 50, a pair of drums 40 fixedly mounted around the rotary shaft 50 to rotate therewith and each mounted in a corresponding one of the guiding bracket assemblies 10, two ropes 60 each securely attached to a corresponding one of the drums 40 and each having two free ends each respectively extending through a corresponding one of the channels 16 of the associated guiding bracket assembly 10 for controlling rotational angles of a plurality of slats 34 of the Venetian blind 30, a lift cord 70 having one free end passing through the passage 14 one proximate guiding bracket assembly 10 and slidably mounted on the associated roller 20 and extending through the associated elongated slot 156 of the guiding bracket assembly 10 to fasten one end of the plurality of slats 34, the other free end of the lift cord 70 passing through the passage 14 of the other distal guiding bracket assembly 10 and slidably mounted on the associated roller 20 and extending through the associated elongated slot 156 to fasten the other end of the plurality of slats 34, thereby being capable of lifting/lowering the slats 34.

Accordingly, by such an arrangement, the roller 20 together with the pivot axle 21 is able to be arbitrarily fitted in either one of the elongated grooves 171, therefore, the lift cord 70 is freely chosen to be fitted on the right end or left end of the Venetian blind 30, thereby greatly facilitating operation of the Venetian blind 30 and largely decreasing cost in manufacturing.

It should be clear to those skilled in the art that further embodiments of the present invention may be made without departing from the teachings of the present invention.

What is claimed is:

1. A guiding bracket assembly for a Venetian blind which comprises a headrail substantially U-shaped in section, said headrail comprising two side walls each having a hook portion extending inwardly and downwardly from an upper end portion thereof, a pair of first sockets each defined in an underside of said headrail and each respectively located adjacent to a corresponding one of said two side walls, a second socket defined in the underside of said headrail and located between said pair of first sockets, said guiding bracket assembly comprising:

a base plate mounted on the underside of said headrail and having two distal ends, an elongated slot vertically defined through a mediate portion of said base plate and communicating with said second socket of said headrail;

a pair of parallel side plates each formed on a corresponding one of the two distal ends of said base plate and each extending upwardly therefrom, a passage transversely defined through a lower portion of each of said pair of side plates, a flange portion formed on one distal end of each of said two side plates and protruding upwardly therefrom to be received in said hook portion of one of said two side walls;

a pair of opposite extension portions each laterally and horizontally formed on said base plate and each extending outwardly therefrom, a lug portion formed on an underside of each of said two extension portions and extending downwardly therefrom to be received in a corresponding one of said pair of first sockets of said headrail, a channel vertically defined through each of said two extension portions and an associated said lug portion, a snapping member laterally formed on one of said two lug portions and urging against the underside of said headrail;

a supporting member formed on an upperside of said base plate and protruding upwardly therefrom, two juxtaposed elongated grooves each laterally defined in said supporting member and each communicating with each other, said elongated slot of said base plate communicating with and located between said two elongated grooves; and a pivot axle rotatably and removably mounted in either one of said two elongated grooves alternatively and interchangeably, a roller fixedly mounted around said pivot axle and partially enclosing said elongated slot of said base plate.

2. The guiding bracket assembly in accordance with claim 1, wherein each of said two side plates has a recess defined in an upper portion thereof, each of said two recesses being defined by a first side and a second side of the upper portion of each of said two side plates, a pair of stop members each respectively formed on the first side of one recess and the second side of the other recess and each partially enclosing associated said recess.

* * * * *